US009957083B2

(12) United States Patent
Chou et al.

(10) Patent No.: US 9,957,083 B2
(45) Date of Patent: May 1, 2018

(54) COMPOSITE PALLET STRUCTURE

(71) Applicants: Huang-Jung Chou, Tainan (TW); Jui-Chuan Tseng, Taipei (TW)

(72) Inventors: Huang-Jung Chou, Tainan (TW); Jui-Chuan Tseng, Taipei (TW)

( * ) Notice: Subject to any disclaimer, the term of this patent is extended or adjusted under 35 U.S.C. 154(b) by 0 days. days.

(21) Appl. No.: 15/682,702

(22) Filed: Aug. 22, 2017

(65) Prior Publication Data

US 2018/0093795 A1 Apr. 5, 2018

(30) Foreign Application Priority Data

Oct. 4, 2016 (TW) ..... 105132296 A

(51) Int. Cl.
*B65D 19/00* (2006.01)
*B65D 19/40* (2006.01)

(52) U.S. Cl.
CPC ..... *B65D 19/0069* (2013.01); *B65D 19/40* (2013.01); *B65D 2519/00034* (2013.01); *B65D 2519/00069* (2013.01); *B65D 2519/00552* (2013.01); *B65D 2519/00955* (2013.01)

(58) Field of Classification Search
CPC ..... B65D 2519/00547; B65D 2519/00368; B65D 2519/00552; B65D 19/00
USPC ..... 108/51.11, 56.3, 57.26, 56.1
See application file for complete search history.

(56) References Cited

U.S. PATENT DOCUMENTS 4,128,253 A * 12/1978 Powers ..... B65D 19/0012 108/55.1
4,735,154 A * 4/1988 Hemery ..... B65D 19/0012 108/56.1
5,809,902 A * 9/1998 Zetterberg ..... B65D 19/0069 108/51.11
5,868,080 A * 2/1999 Wyler ..... B65D 19/0022 108/57.25
6,021,721 A * 2/2000 Rushton ..... B65D 19/00 108/56.3
6,029,583 A * 2/2000 LeTrudet ..... B65D 19/0012 108/57.25
6,216,608 B1 * 4/2001 Woods ..... B65D 19/0012 108/56.1
7,004,083 B2 * 2/2006 Ramirez von Holle ..... B65D 19/0026 108/57.25
7,490,561 B1 * 2/2009 Chou ..... B65D 19/0095 108/56.1

(Continued)

FOREIGN PATENT DOCUMENTS

TW I356030 B 1/2012

*Primary Examiner* — Jose V Chen

(74) *Attorney, Agent, or Firm* — Alan D. Kamrath; Kamrath IP Lawfirm, P.A.

(57) ABSTRACT

A composite pallet structure includes a unit pallet including: upper and lower basic supporting boards, at least two spaced-apart auxiliary rods attached to each of the corresponding sides of the upper and lower basic supporting boards, a plurality of spacers distributed between the auxiliary rods on the upper basic supporting board and the auxiliary rods on the lower basic supporting board, and a plurality of fixing elements for restricting the spacers within the space between the upper and lower basic supporting boards in order for the unit pallet to have high supporting strength. The composite pallet structure needs no soldering and, therefore, can be easily repaired and recycled.

4 Claims, 9 Drawing Sheets

(56) References Cited

U.S. PATENT DOCUMENTS

| | | | | |
|---|---|---|---|---|
| 7,987,798 | B2 * | 8/2011 | Kim | B65D 19/0095 108/51.11 |
| 8,424,468 | B2 * | 4/2013 | Aden | B65D 19/0026 108/56.3 |
| 2013/0160680 | A1 * | 6/2013 | Ten Bok | B29C 44/0407 108/50.11 |
| 2015/0274358 | A1 * | 10/2015 | Hidalgo | B65D 19/0095 108/56.3 |

* cited by examiner

COMPOSITE PALLET STRUCTURE

BACKGROUND OF THE INVENTION

1. Technical Field

The present invention relates to a composite pallet structure and, more particularly, to one including a unit pallet. The unit pallet includes: an upper basic supporting board, a lower basic supporting board, at least two spaced-apart auxiliary rods attached to each of the corresponding sides of the upper and lower basic supporting boards, a plurality of spacers distributed between the two auxiliary rods on the upper basic supporting board and the two auxiliary rods on the lower basic supporting board, and a plurality of fixing elements for restricting the spacers within the space between the upper and lower basic supporting boards in order for the resulting unit pallet to have a high supporting strength. The composite pallet structure of the present invention does not need soldering and, therefore, can be easily repaired and recycled.

2. Description of Related Art

Nowadays, an elevated pallet, on which various objects can be placed, is generally made by cutting wood material to size and then nailing the cut pieces together to form an elevated pallet of a predetermined configuration. The relatively high cost of wooden pallets, however, has led to the development of plastic elevated pallets that are injection-molded to the desired dimensions, allowing manufacturers to put finished products on such pallets and transfer the products together with the pallets to their intended storage locations with a forklift. As is well known in the art, making a plastic elevated pallet by injection molding requires a mold conforming to the finished pallet and a molding machine to which the mold can be mounted in order to be injected with a plastic molding material in the injection molding process. In consequence, the cost of molding large elevated pallets, whose injection molding machines are hefty, is relatively high. Since a pallet manufacturer intending to make elevated pallets of different sizes must have different molds and different injection molding machines, the capital cost of the factory will be considerable. In addition, the factory must be large and high enough to accommodate those large injection molding machines designed for making large elevated pallets, as the machines are bound to be larger than the molds required. A factory with limited space, therefore, is not suitable for producing large pallets. Besides, large pallets tend to have a problem being stacked efficiently during transportation and end up occupying a lot of space.

Also, a plastic pallet, be it of a regular (i.e., relatively small) size or a width-extended size, has a limit for internal stress and may crack or even break (and hence become useless) if overloaded for some time. Moreover, a width-extended pallet cannot be made without a larger-than-regular mold and molding machine, which however incur an increase in cost. Furthermore, while it is feasible to form pallets of predetermined configurations out of metal to overcome the problem of insufficient supporting strength, the production cost of metal pallets is prohibitively high.

In view of the above, the present invention relates to a regular-size pallet which can be mass-produced and extended in size according to practical needs, as disclosed in Taiwan Invention Patent No. I356030, granted on Jan. 11, 2012 and titled "Structure for Pallet Assembly". This pallet is assembled from at least two unit boards to achieve the desired dimensions. Depending on the widths of the objects to be carried by the pallet, the width of the pallet can be easily adjusted to produce a stable elevated pallet assembly. The production (including molding) cost of the pallet is therefore much lower than its conventional counterparts, and a plurality of such pallets can be stacked with ease during transportation.

The present invention, on one hand, preserves the feature of flexible assembly of the aforesaid patented plastic pallet and, on the other hand, solves the problem of insufficient pallet supporting strength by attaching at least two spaced-apart auxiliary rods to each of the corresponding sides of the upper basic supporting board and the lower basic supporting board of a unit pallet, by distributing a plurality of spacers between the auxiliary rods on the upper basic supporting board and the auxiliary rods on the lower basic supporting board, and by restricting the spacers within the space between the upper and lower basic supporting boards with a plurality of fixing elements in order for the unit pallet to have high supporting strength.

BRIEF SUMMARY OF THE INVENTION

The present invention provides a novel pallet assembly based on the configuration of the plastic pallet disclosed in the afore-cited Taiwan patent. The novel pallet assembly of the present invention includes a unit pallet including: an upper basic supporting board, a lower basic supporting board, at least two spaced-apart auxiliary rods attached to each of the corresponding sides of the upper and lower basic supporting boards, a plurality of spacers distributed between the two auxiliary rods on the upper basic supporting board and the two auxiliary rods on the lower basic supporting board, and a plurality of fixing elements for restricting the spacers within the space between the upper and lower basic supporting boards in order for the resulting unit pallet to have a high supporting strength.

The primary objective of the present invention is to provide a unit pallet featuring flexible width extension and high supporting strength. The unit pallet includes: an upper basic supporting board, a lower basic supporting board, at least two spaced-apart auxiliary rods attached to each of the corresponding sides of the upper and lower basic supporting boards, a plurality of spacers distributed at equal or unequal spacings between the two auxiliary rods on the upper basic supporting board and the two auxiliary rods on the lower basic supporting board, and a plurality of fixing elements for restricting the spacers. Each spacer extends across the two auxiliary rods on each of the upper and lower basic supporting boards and within the space between the upper and lower basic supporting boards. The number of the spacers, the width of the unit pallet, and the number of the upper and lower basic supporting boards may be increased according to the weights and sizes of the objects to be placed on the unit pallet, in order for the resulting unit pallet to have high supporting strength and a flexibly assembled supporting surface. This composite pallet of the present invention does not require soldering and, therefor, can be repaired and recycled with ease.

The second objective of the present invention is for each of two lateral edges of the inner side of each of the upper and lower basic supporting boards of the unit pallet to be attached with an L-shaped edge plate such that the spacers are distributed between and each extend across the L-shaped edge plates on the two lateral edges of each of the upper and lower basic supporting boards, and for the fixing elements to restrict the spacers within the space between the upper and lower basic supporting boards, so that the unit pallet as a whole has a high supporting strength.

The third objective of the present invention is for each fixing element of the unit pallet, which as stated above, is used to restrict the spacers extending across the two auxiliary rods on each of the upper and lower basic supporting boards within the space between the upper and lower basic supporting boards, and includes a fastening member and a press-fit member. The fastening member has an inner section formed with spaced-apart elastic stopper portions, while the press-fit member is received in a space at one end of the fastening member. The spaced-apart elastic stopper portions at one end of each fastening member are guided through a predetermined hole in one of the upper and lower basic supporting boards and a corresponding predetermined hole in one of the spacers. Once restoring their spread configuration, the elastic stopper portions are restricted on one side of the one of the upper and lower basic supporting boards, with the corresponding press-fit member subsequently pushed into the fastening member. Thus, the upper and lower basic supporting boards and the spacers are secured in the intended configuration.

The fourth objective of the present invention is to provide a unit pallet that is elevated as a whole and features flexible width extension and high supporting strength. The unit pallet includes: a plurality of elevated bases of a predetermined width, at least two spaced-apart auxiliary rods placed on upper portions of the elevated bases, at least one basic supporting board of a predetermined width laid over the auxiliary rods, and a plurality of fixing elements for restricting the basic supporting board, which is laid over the auxiliary rods, to the elevated bases. The number of the at least one basic supporting board may be increased according to the required placement height, weights, and sizes of the objects to be placed on the unit pallet, in order for the resulting unit pallet to have a flexibly assembled supporting surface and high supporting strength.

The fifth objective of the present invention is for each of two lateral edges of the inner side of each basic supporting board of the unit pallet to be attached with an L-shaped edge plate, and for the fixing elements to restrict both the at least one basic supporting board, which is laid over the auxiliary rods, and the L-shaped edge plates to the elevated bases, so that the unit pallet as a whole has high supporting strength.

The sixth objective of the present invention is for each fixing element of the unit pallet, which as stated above, is used to restrict the basic supporting board laid over the spaced-apart auxiliary rods to the elevated bases, and includes a fastening member and a press-fit member. The fastening member has an inner section formed with spaced-apart elastic stopper portions while the press-fit member is received in a space at one end of the fastening member. The spaced-apart elastic stopper portions at one end of each fastening member are guided through a predetermined hole in the basic supporting board and a corresponding predetermined hole in one of the elevated bases. Once restoring their spread configuration, the elastic stopper portions are restricted on one side of the one of the elevated bases, with the corresponding press-fit member subsequently pushed into the fastening member. Thus, the basic supporting board and the elevated bases are secured in the intended configuration.

DETAILED DESCRIPTION OF THE INVENTION

Figure 1:
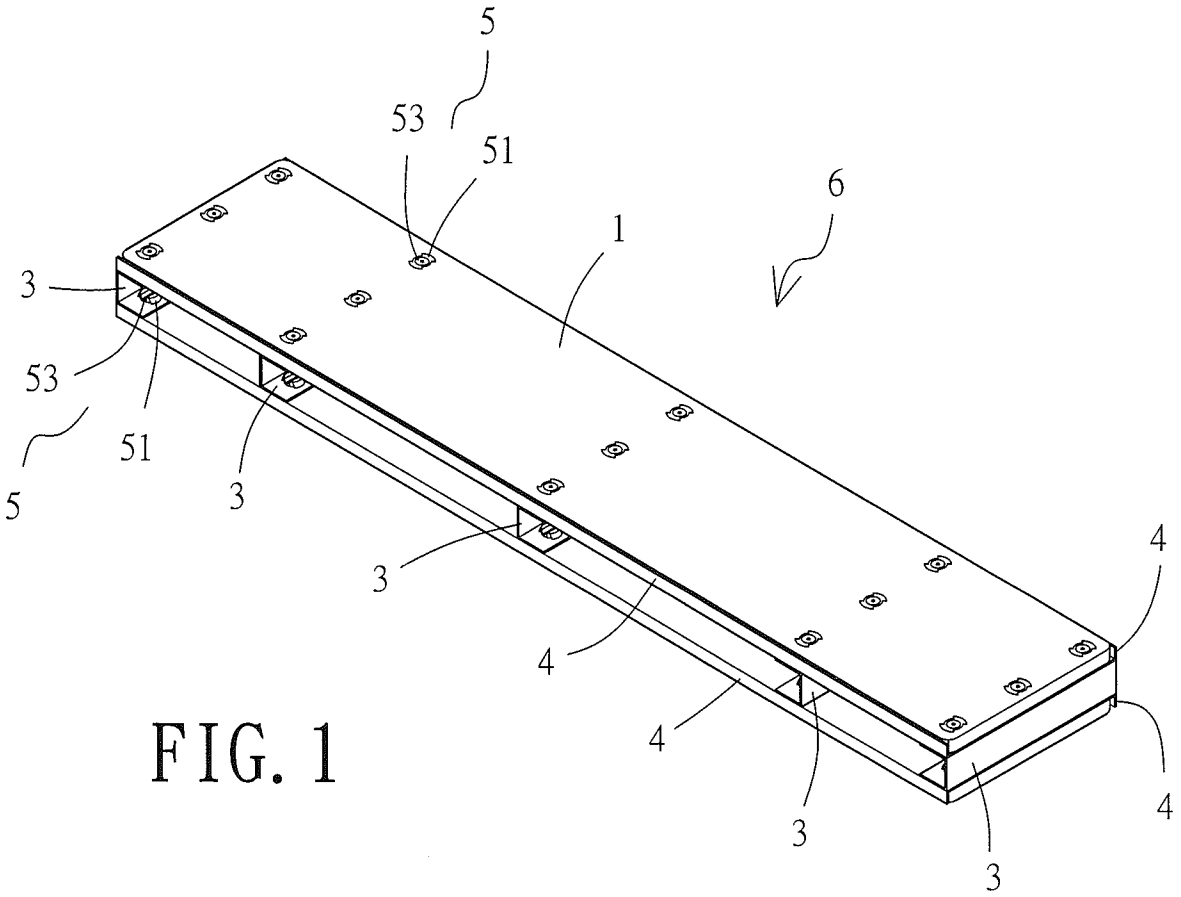
FIG. 1 is an assembled perspective view of a unit pallet according to the present invention.
Figure 2:
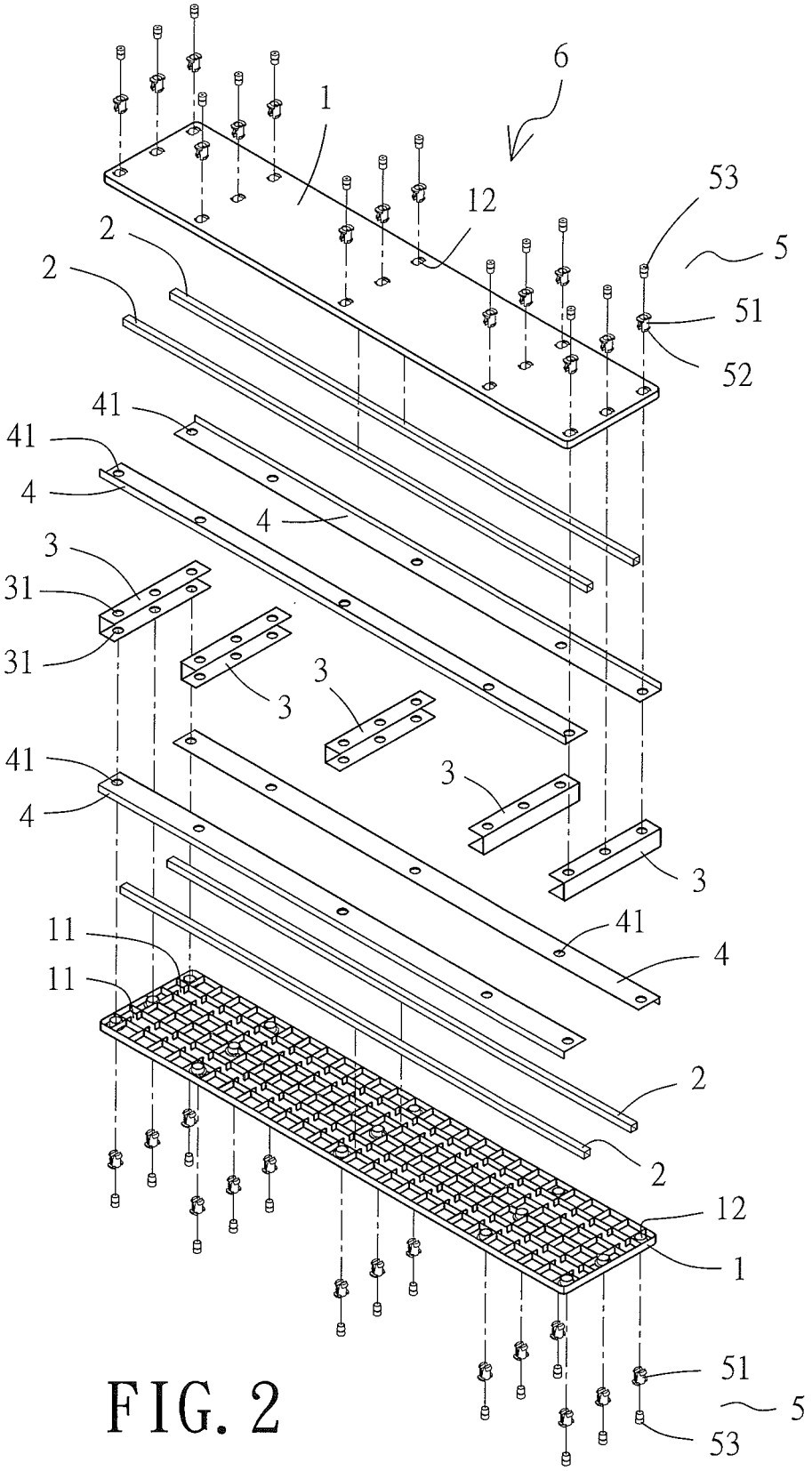
FIG. 2 is an exploded perspective view of the unit pallet in FIG. 1.
Figure 3:
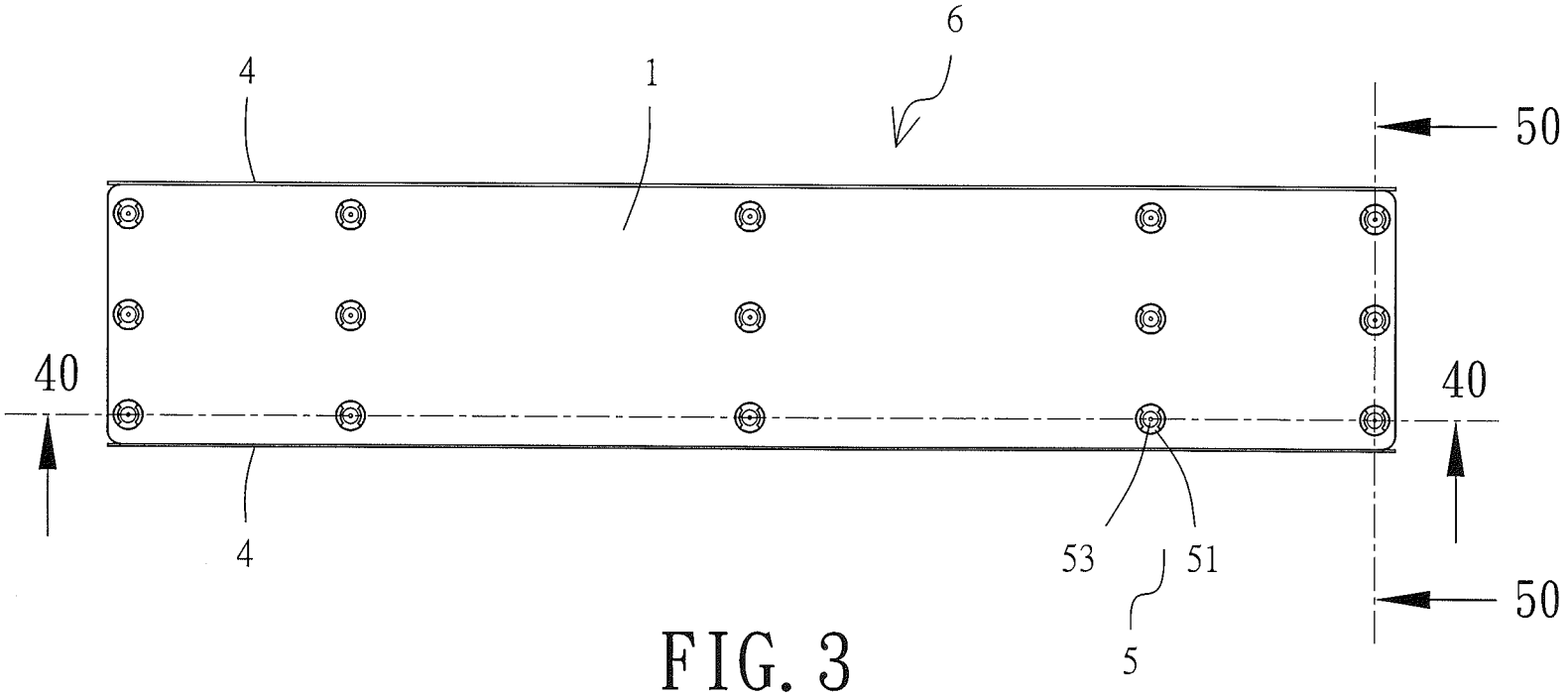
FIG. 3 is an assembled top view of the unit pallet in FIG. 1.
Figure 4:
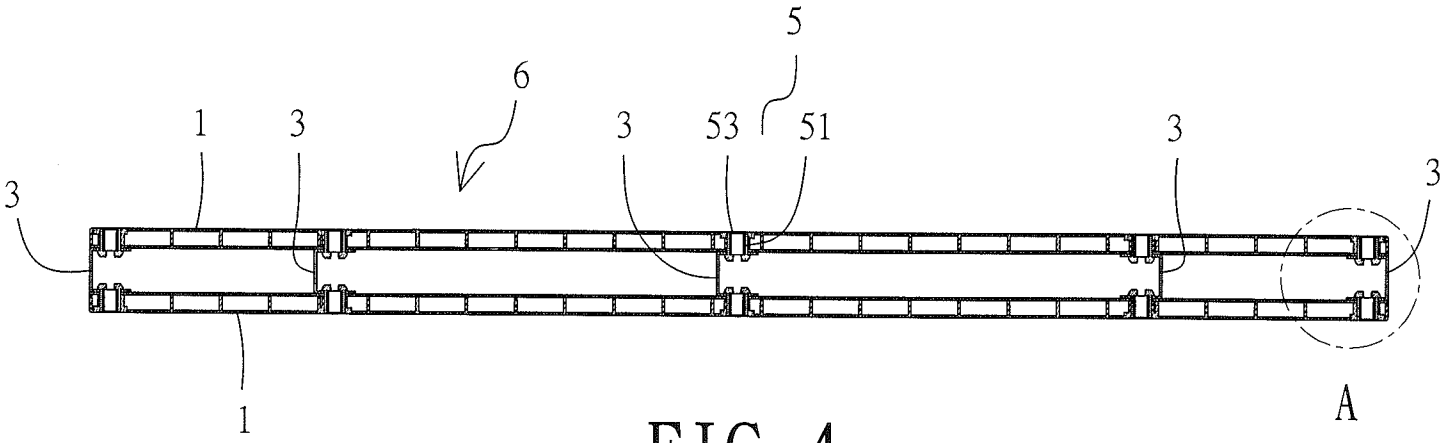
FIG. 4 is a sectional view taken along the line 40-40 in FIG. 3.
Figure 4A:
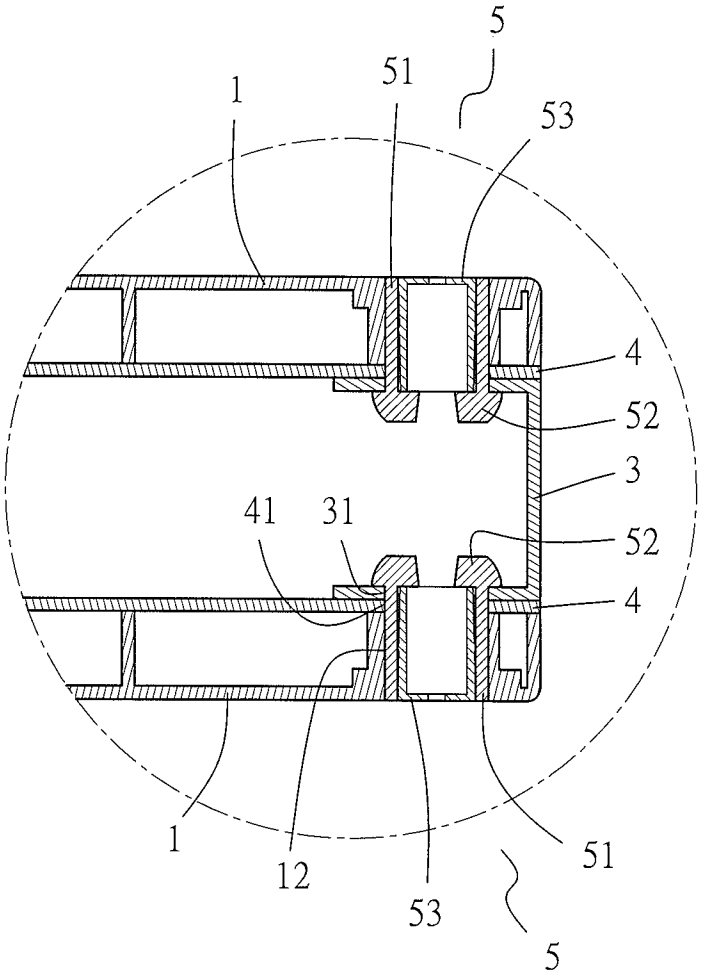
FIG. 4A is an enlarged view of the circled area A in FIG. 4.

The present invention provides a composite pallet structure including a unit pallet 6, and the unit pallet 6 features flexible width extension and high supporting strength. Referring to FIG. 2, the unit pallet 6 includes an upper basic supporting board 1, a lower basic supporting board 1, at least two spaced-apart auxiliary rods 2 (see FIG. 3 and FIG. 5) attached to each of the corresponding sides of the upper and lower basic supporting boards 1, a plurality of spacers 3 (each having a recumbent square-U shaped cross section by way of example) distributed at equal or unequal spacings between the two auxiliary rods 2 on the upper basic supporting board 1 and the two auxiliary rods 2 on the lower basic supporting board 1 (see FIG. 4), and a plurality of fixing elements 5 for restricting the spacers 3 (each extending across the two auxiliary rods 2 on each of the upper and lower basic supporting boards 1) within the space between the upper and lower basic supporting boards 1 (see FIG. 4A). Based on the weights and sizes of the objects to be placed on the unit pallet 6, the number of the spacers 3 may be increased, and so may the width of the unit pallet 6 and the number of the upper and lower basic supporting boards 1 (see FIG. 6), in order for the resulting unit pallet 6 (see FIG. 1) to have high supporting strength and a flexibly assembled supporting surface.

Figure 5:
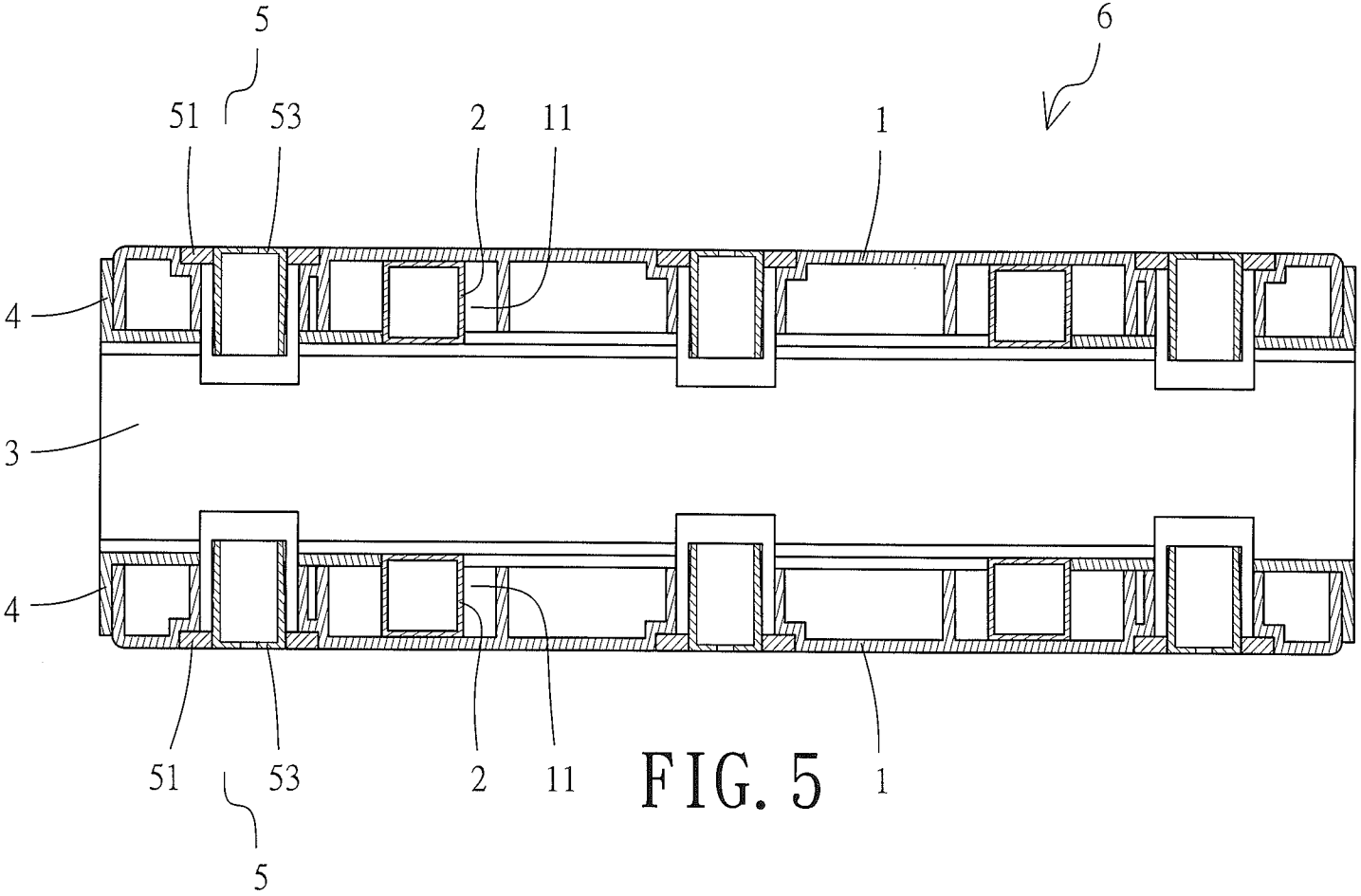
FIG. 5 is a sectional view taken along the line 50-50 in FIG. 3.
Figure 6:
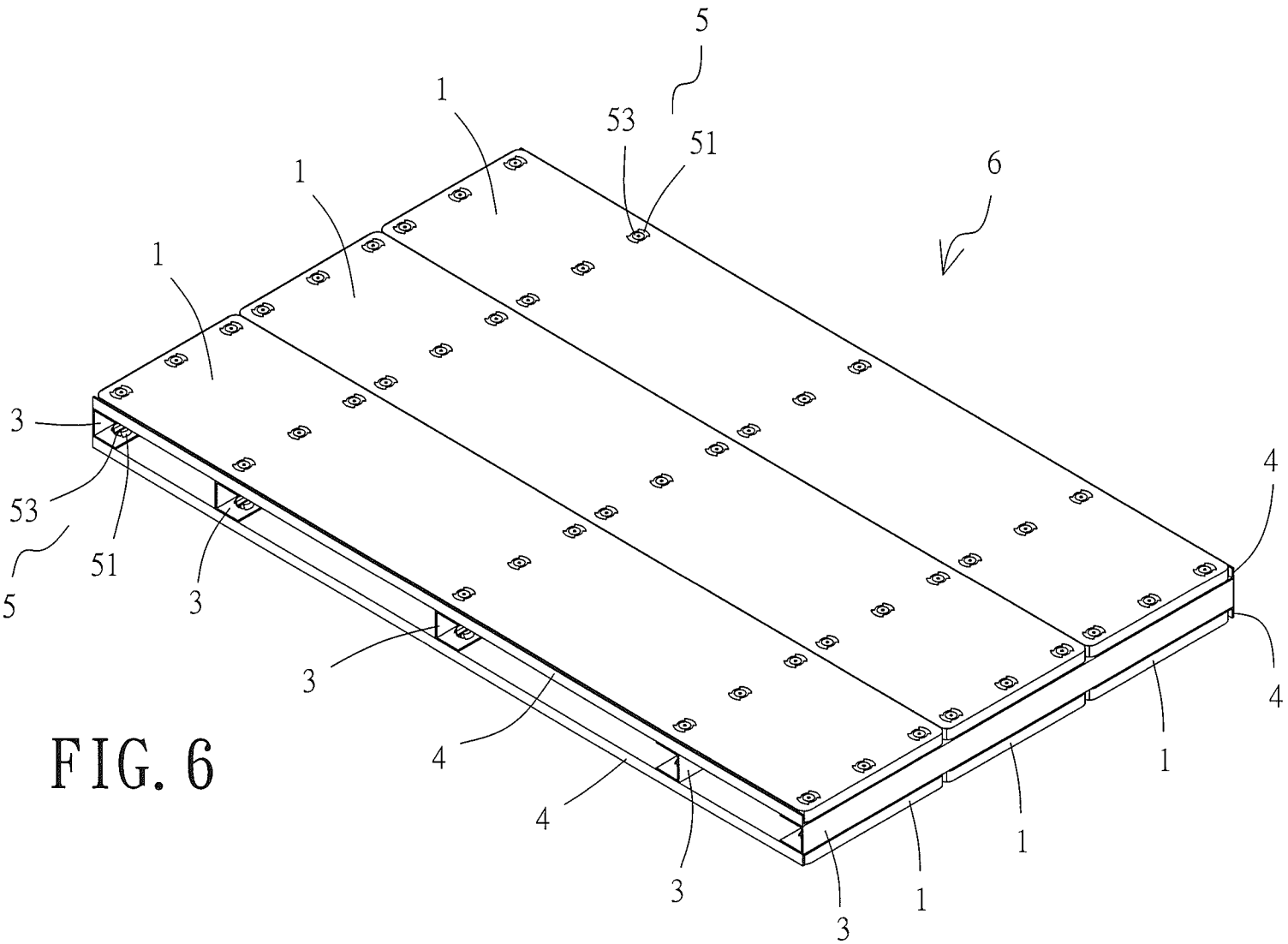
FIG. 6 is an assembled perspective view of a width-extended version of the unit pallet in FIG. 1.

The at least two auxiliary rods 2 on each of the upper and lower basic supporting boards 1 are placed in concave areas 11 of the basic supporting board respectively (see FIG. 5). Each concave area 11 extends over a predetermined range. The auxiliary rods 2 are made of metal and are in the form of tubes having a square cross section by way of example. The fixing elements 5 for restricting the spacers 3, each of which extends across the two auxiliary rods 2 on each basic supporting board 1, will be described in more detail below.

The inner side of each of the upper and lower basic supporting boards 1 of the unit pallet 6 has two lateral edges each attached with an L-shaped edge plate 4 (see FIG. 2 and FIG. 5). The spacers 3 are distributed between the L-shaped edge plates 4 on the two lateral edges of each of the upper and lower basic supporting boards 1 (in this embodiment, the L-shaped edge plates 4 are made of metal by way of example), and each spacer 3 extends across the L-shaped edge plates 4 on the two lateral edges of each of the upper and lower basic supporting boards 1. Therefore, once the spacers 3 are restricted within the space between the upper and lower basic supporting boards 1 by the fixing elements 5, the unit pallet 6 as a whole has high supporting strength.

The fixing elements 5 for restricting the spacers 3, each of which extends across the two L-shaped edge plates 4 on each basic supporting board 1, will be described in more detail below.

The fixing elements 5 of the unit pallet 6 are configured for restricting the spacers 3, each of which extends across the two auxiliary rods 2 on each basic supporting board 1, within the space between the upper and lower basic supporting boards 1 (see FIG. 2 and FIG. 4A), and each fixing element 5 includes a fastening member 51 and a press-fit member 53. The fastening member 51 has an inner section formed with spaced-apart elastic stopper portion 52, and the press-fit member 53 is received in a space at one end of the fastening member 51. The spaced-apart elastic stopper portions 52 at one end of each fastening member 51 are guided through a predetermined hole 12 in one of the upper and lower basic supporting boards 1, a corresponding predetermined hole 41 (if existing) in one of the L-shaped edge plates 4, and a corresponding predetermined hole 31 in one of the spacers 3, before restoring their spread configuration and thus being restricted on one side of the one of the upper and lower basic supporting boards 1 (see FIG. 4A). The corresponding press-fit member 53 is then pushed into the fastening member 51. Thus, the upper and lower basic supporting boards 1, the L-shaped edge plates 4, and the spacers 3 are secured in the intended configuration.

Figure 7:
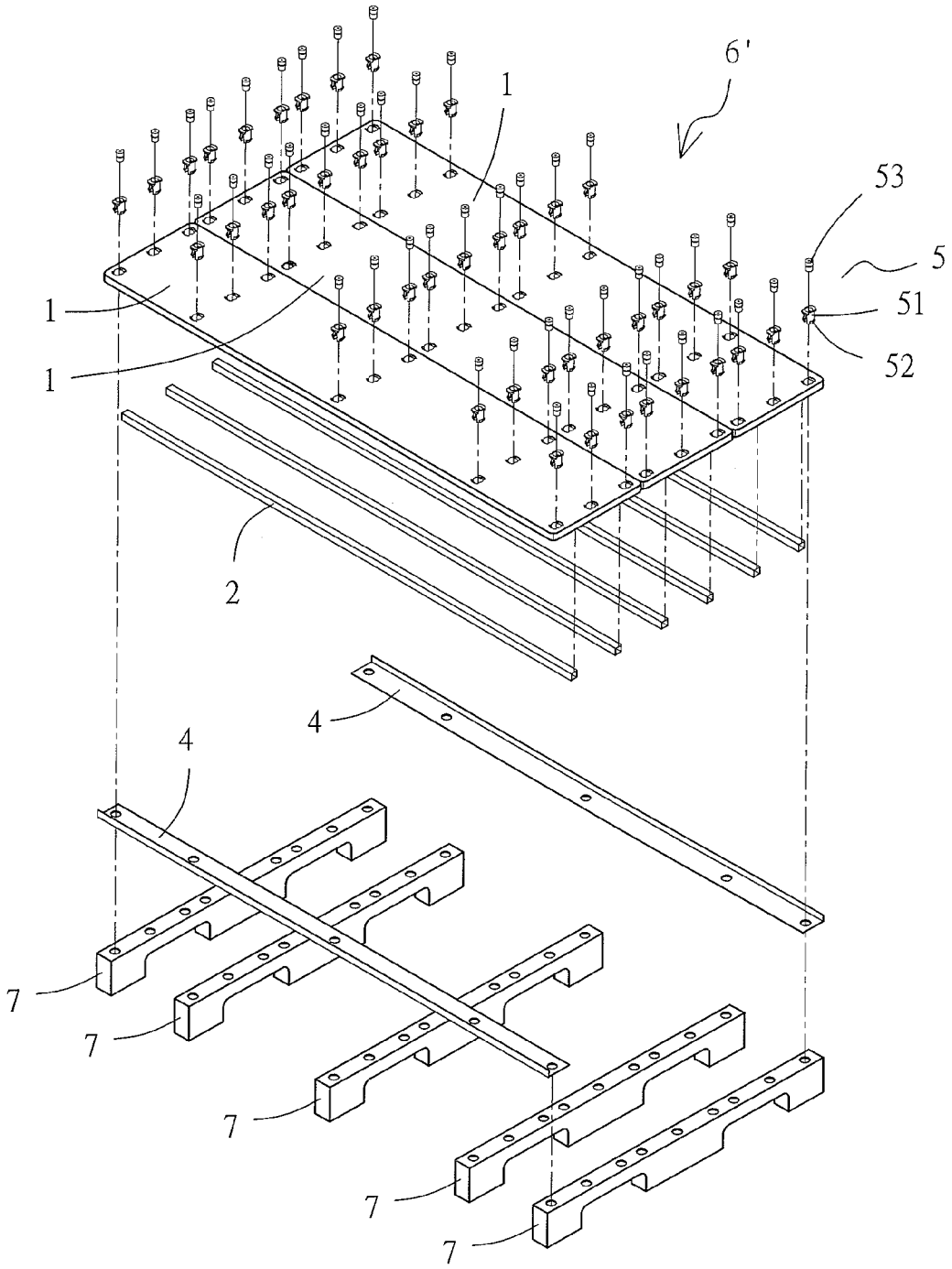
FIG. 7 is an exploded perspective view of a width-extended elevated unit pallet according to the present invention.
Figure 8:
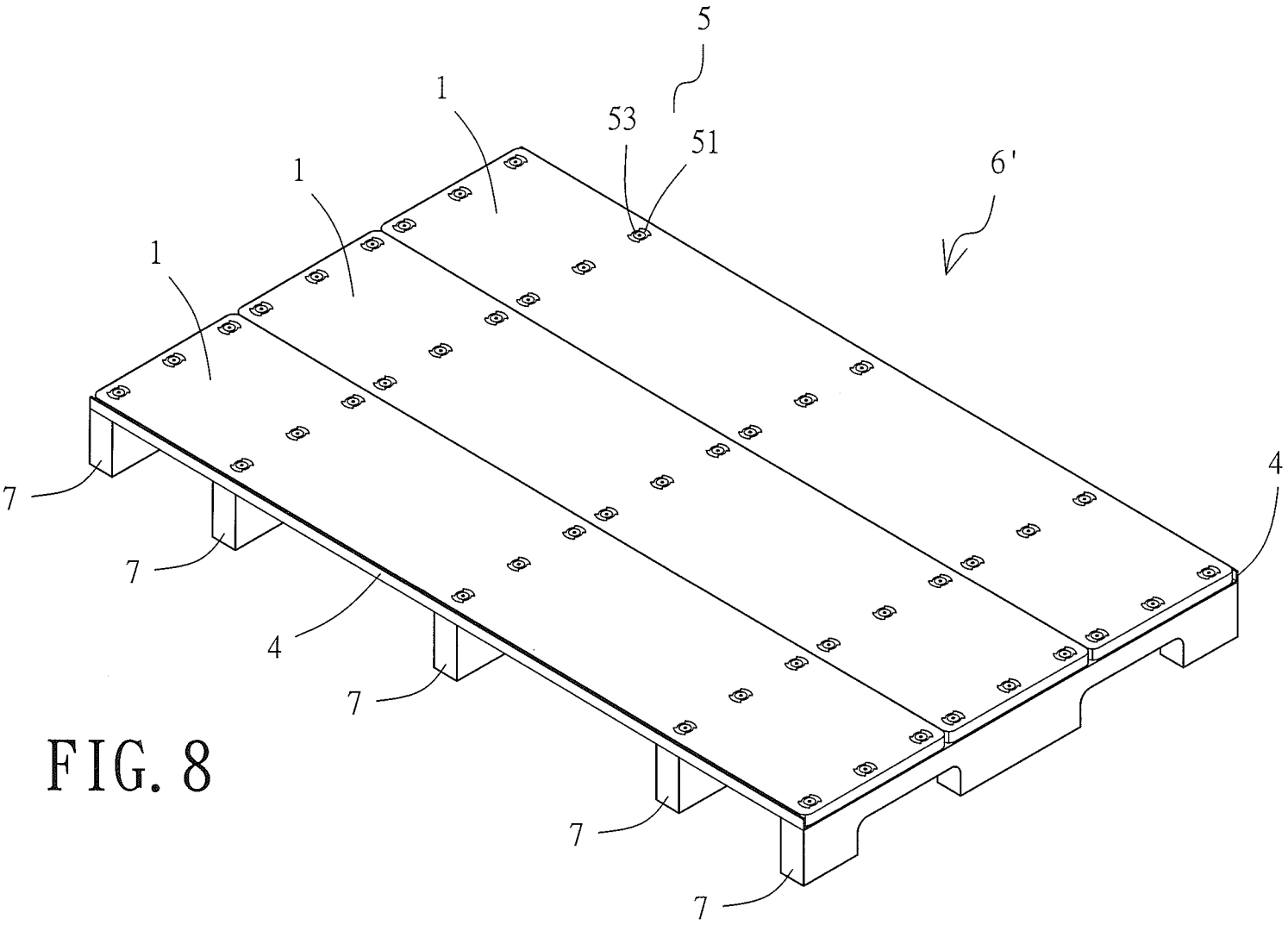
FIG. 8 is an assembled perspective view of the elevated unit pallet in FIG. 7.

FIG. 7 shows the unit pallet 6' in the second embodiment of the present invention. The unit pallet 6' is elevated as a whole, allows flexible extension in width and has high supporting strength. The unit pallet 6' includes: a plurality of elevated bases 7 of a predetermined width, at least two spaced-apart auxiliary rods 2 provided on upper portions of the elevated bases 7 (in this embodiment, the auxiliary rods 2 are made of metal and are in the form of tubes having a square cross section by way of example), at least one basic supporting board 1 of a predetermined width (see FIG. 8) laid over the auxiliary rods 2, and a plurality of fixing elements 5 for restricting the basic supporting boards 1, which are laid over the auxiliary rods 2, to the elevated bases 7. Based on the required placement height, weights, and sizes of the objects to be placed on the unit pallet 6', the number of the basic supporting boards 1 may be increased in order for the resulting unit pallet 6' to have high supporting strength and a flexibly assembled supporting surface.

The inner side of each basic supporting board 1 of the unit pallet 6' has two lateral edges each attached with an L-shaped edge plate 4 (see FIG. 7). The basic supporting boards 1, which are laid over the auxiliary rods 2, and the L-shaped edge plates 4 (which, in this embodiment, are made of metal by way of example) are restricted to the elevated bases 7 by the fixing elements 5 such that the unit pallet 6' as a whole has high supporting strength.

The fixing elements 5 of the unit pallet 6' are configured for restricting the basic supporting boards 1, which are laid over the spaced-apart auxiliary rods 2, to the elevated bases 7, and each fixing element 5 includes a fastening member 51 and a press-fit member 53. The fastening member 51 has an inner section formed with spaced-apart elastic stopper portions 52, and the press-fit member 53 is received in a space at one end of the fastening member 51. The spaced-apart elastic stopper portions 52 at one end of each fastening member 51 are guided through a predetermined hole in one of the basic supporting boards 1 and a corresponding predetermined hole in one of the elevated bases 7, before restoring their spread configuration and thus being restricted on one side of the one of the elevated bases 7. The corresponding press-fit member 53 is then pushed into the fastening member 51. Thus, the basic supporting boards 1 and the elevated bases 7 are secured in the intended configuration.

The elevated bases 7 as well as the basic supporting boards 1 described above with reference to FIG. 2 and FIG. 7 are formed of a tough material and have a proper width.

What is claimed is:

1. A unit pallet comprising: an upper basic supporting board; a lower basic supporting board; a plurality of spacers distributed at equal or unequal spacings between corresponding sides of the upper basic supporting board and the lower basic supporting board; a plurality of fixing elements each having a fastening member and a press-fit member, with each said fastening member having spaced-apart elastic stopper portions, with each said press-fit member being received in a space at an end of a corresponding fastening member, with the plurality of fixing elements securing the upper basic supporting board, the lower basic supporting board, and the plurality of spacers in a predetermined configuration; and at least two spaced-apart auxiliary rods attached to each of the corresponding sides of the upper basic supporting board and the lower basic supporting board, wherein the plurality of spacers is distributed between the at least two spaced-apart auxiliary rods on the upper basic supporting board and the at least two spaced-apart auxiliary rods on the lower basic supporting board, wherein the plurality of spacers and the at least two spaced-apart auxiliary rods being restricted between the upper basic supporting board and the lower basic supporting board in position by the plurality of fixing elements securing the upper and lower basic supporting boards and the plurality of spacers.

2. The composite pallet structure of claim 1, wherein each of the upper basic supporting board and the lower basic supporting board of the unit pallet has an inner side with two lateral edges, wherein each of the two lateral edges is attached with an L-shaped edge plate, wherein the plurality of spacers is distributed between and each extend across the L-shaped edge plates on the two lateral edges of each of the upper basic supporting board and the lower basic supporting board, and wherein the plurality of fixing elements restricts the plurality of spacers within a space between the upper basic supporting board and the lower basic supporting board.

3. A unit pallet comprising: a plurality of elevated bases of a predetermined width; at least one basic supporting board of a predetermined width; a plurality of fixing elements arranged at a predetermined spacing along the plurality of elevated bases and the at least one basic supporting board, with each said fixing element having a fastening member and a press-fit member, with each said fastening member having spaced-apart elastic stopper portions, with each said press-fit member being received in a space at an end of a corresponding said fastening member, with the plurality of fixing elements securing the plurality of elevated bases and the at least one basic supporting board in a predetermined configuration; and at least two auxiliary rods provided between the plurality of elevated bases and the at least one basic supporting board, wherein the at least two auxiliary rods is restricted between the plurality of elevated bases and the at least one basic supporting board in position by the plurality of fixing elements securing the plurality of elevated bases and the at least one basic supporting board.

4. The composite pallet structure of claim 3, wherein each of the at least one basic supporting board has an inner side with two lateral edges, wherein each of the two lateral edges is attached with an L-shaped edge plate, wherein the plurality of fixing elements restricts the at least one basic supporting board laid over the at least two spaced-apart auxiliary rods and the L-shaped edge plates of the two lateral edges to the plurality of elevated bases.

* * * * *